US005486247A

United States Patent [19]

Engsbråten

[11] Patent Number: 5,486,247

[45] Date of Patent: Jan. 23, 1996

[54] EXPLOSIVE COMPOSITION, MANUFACTURE AND USE THEREOF

[76] Inventor: Björn Engsbråten, Dolomitvägen 8, S-703 74 Öbrebro, Sweden

[21] Appl. No.: 13,434

[22] Filed: Feb. 4, 1993

[51] Int. Cl.[6] ..... C06B 31/28

[52] U.S. Cl. ..... 149/46

[58] Field of Search ..... 149/46

[56] References Cited

U.S. PATENT DOCUMENTS

| | | | |
|---|---|---|---|
| 4,248,644 | 2/1981 | Healey | 149/21 |
| 4,493,741 | 1/1985 | Ducote et al. | 149/19.4 |
| 4,507,161 | 3/1985 | Sujawsky et al. | 149/21 |
| 4,764,230 | 8/1988 | Bates et al. | 149/21 |
| 4,790,891 | 12/1988 | Halliday et al. | 149/2 |
| 5,026,442 | 6/1991 | Yabsley et al. | 149/2 |

FOREIGN PATENT DOCUMENTS

| | | |
|---|---|---|
| 29582/57 | 1/1958 | Australia . |
| 10182/66 | 2/1965 | Australia . |
| 16774/67 | 7/1968 | Australia . |
| 37034/89 | 1/1990 | Australia . |
| 78385/91 | 12/1991 | Australia . |
| 58127/90 | 6/1993 | Australia . |
| 1571215 | 11/1970 | Germany . |
| 1571220 | 11/1970 | Germany . |
| WO90/15788 | 12/1990 | WIPO . |

*Primary Examiner*—Donald P. Walsh
*Assistant Examiner*—Anthony R. Chi
*Attorney, Agent, or Firm*—Burns, Doane, Swecker & Mathis

[57] ABSTRACT

Explosive composition, and method for its manufacture, based on an essentially particulate mixture containing a solid oxidizing salt and optionally a fuel, wherein at least a part of the oxidizing salt contains ammonium ion. The mixture contains an additive of acid and may be used in environments with risk of ammonia liberation.

16 Claims, No Drawings

EXPLOSIVE COMPOSITION, MANUFACTURE AND USE THEREOF

TECHNICAL FIELD

The present invention relates to explosive compositions based on essentially particulate mixtures containing a solid oxidizing salt and a fuel, as well as use and method for manufacture of such compositions.

Particulate explosive compositions have found broad application because non-expensive raw materials and simple manufacture give the product a relatively low price while the particulate and free flowing properties of the explosive facilitates transport and charging. A disadvantage of this explosive type is that the final charge is not homogeneous but porous, (i.e., admits the passage of the ambient atmosphere between particles) and that the oxidizing salt is relatively unprotected against water. Hence disintegration of the explosive takes place in moist environments. The most common form of particulate explosive contains prills of ammonium nitrate as oxidizing salt and fuel oil as fuel (ANFO). A special problem with the ammomium ion comprising salts is experienced in basic environments where the ammonium ion decays and liberates ammonia. Besides the negative influence on the explosive, an environmental problem arises especially in closed spaces as in underground blasting. A basic environment may exist in connection with basic minerals or in connection with constructions of cement or concrete. Contact with the basic materials can take place directly at charging of the explosive in the materials or through contact with explosive spillage or explosive residues after blasting.

It is known to try to reduce the water sensitivity of the particulate explosive by various additives, mainly by preventing exposure of the salt to the water. Problems in this connection are posed by the fact that pulverulent additives tend to separate and segregate in the particulate mixture while liquid additives affect mixture viscosity with corresponding deposition problems in equipments for transport and charging. Normally the additives also affect the oxygen balance or the distribution between oxidant and fuel in the mixture. The selection of additive compounds is also limited by the low price character of the explosive. Finally it can be concluded that that none of the known products of this kind is effective for prevention of ammonia liberation since only very small ammonia amounts are needed to give rise to environmental problems.

The invention in general

A main object of the present invention is to offer an explosive composition of the stated type by which problems with ammonia liberation in connection with basic environments can be avoided. A special object with the composition is to avoid the problems without substantially increasing the costs for the product. A further object is to correct the problems without causing other environmental problems. Yet an object is to offer a composition which can be manufactured in a simple way. Another object is to offer a composition which with simple means, also in the field, by choice and in a flexible way can be made insensitive to basic environments.

These objects are reached with the characteristics evident from the claims.

By making an acid additive to a particulate explosive containing salt with ammonium ion, the ammonia formation is suppressed in a direct manner. Contrary to previously known additives, which mainly seek to mechanically prevent that external water reaches the salt particles, which in any case cannot be done to such an extent that ammonia release can be avoided, the invention achieves, through the direct chemical influence, that decomposition is prevented both at smaller and larger exposure, which is necessary for covering all situations of deliberate or unintentional contact between the explosive and the basic materials. It also means that the invention can be employed both with and without the earlier known additives. By selecting a strongly water soluble acid additive the intended protective effect is maximized and simultaneously the acid will be essentially compatible with the salt phase with minimal influence on the fuel phase and its distribution in the salt. Strongly water soluble acids also have low fuel value and influence on oxygen balance will consecquently be limited. With solid or pulverulent additives the mixing procedure will be simple an the free-flowing properties of the explosive will rather be improved as the same time as the additive is localized where it has most effect, at the surface of the partices of oxidizing salt. Furtehrmore, since there are no requirements for high acidity the desired requirements are met by cheap and environmentally harmless acids which, especially when selecting organic acids, furthermore are completely consumed in the explosive detonation and do not leave harmful residues.

Further objects and advantages with the invention will be evident from the detailed description below.

DETAILED DESCRIPTION

The explosive composition according to the invention is a particulate mixture of an oxidizing salt, constituting the predominant part of the composition, a lesser amount of acid additive and, to the extent the acid additive or other additives do not have sufficient fuel value for balancing the oxygen content in the salt, a separately added fuel. That the composition is a particulate mixture means that the additives do not fill out the spaces between the salt particles but that interstices are present therebetween. Preferably the additive amounts are low enough to make the particulate mixture behave substantially free-flowing and most preferably as a substantially dry mixture of particles or powder.

A main component of the present composition accordingly is a particulate oxidizing salt, which can be of any suitable kind, such as perchlorates or nitrates as long as ammonium ion is present, but a preferred salt is ammonium nitrate. The structure can be crystalline or that of crushed or ground crystals but preferably the porous prilled type is used. Porous prills can absorb liquid fuels and form an intimate mixture between fuel and oxidant and can easily be charged and adhered by slight compaction. The acid additive will thus minimally affect the fuel and its distribution in the salt. For all types the particle size should be rather big and size distribution narrow. Particle sizes between 0.5 and 10 mm or better between 1 and 5 mm, are suitable. In general terms materials suitable for use in ANFO-explosives are also usable for the present purposes. In addition to the larger particles of this kind, nothing prevents presense of more finely divided salt, for example in order to increase density or limit water penetration. The mount of fine salt can constitute between 5 and 50 percent by volume and in particular between 10 and 40 percent by volume of the total salt amount and the average particle size for the fine salt should be below ⅕ and better 1/10 of the rougher material.

Even if other components of the present compositions may have a fuel value enough to balance the oxygen content in the oxidizing salt, it is preferred that a fuel addition is allowed directly to the oxidizing salt for best detonation properties. The amount of added fuel may correspond to an oil addition of 1 to 10 percent by weight of the oxidizing salt, or better between 2 and 6 percent by weight. For high contents of combustible additives the amount can be reduced to between 0 and 4 and preferably between 1 and 3 percent by weight. Separately added fuel should be of a type allowing penetration in porous prilled salt and the preferred fuel is fuel oil.

In the composition may be included other known additives, e.g. aluminum powder to increase the fuel value, a swelling agent such as guar gum or a hydrophobing agent such as wax, stearate or polymer to increase water resistance or anticaking agents such as amines or finely distributed minerals. The composition may also have reduced strength in relation to normal ANFO by the addition of inert fillers, such as porous minerals or porous polystyrene beads, whereby the composition also may contain an adhesive agent to avoid component segregation in the mixture, e.g. an elastomer or an emulsion according to the Swedish patent application 8800593-9, incorporated herein by reference.

The acid can be added in diluted form, e.g, dissolved in a solvent, emulsified in a matrix or absorbed in a porous mateial, but preferably the acid is added in substantially pure form. However, the acid addition may be a mixture of acids even if substantially pure acids are preferred.

The acid can also be fluid in pure form. A fluid acid additive can be advantageous to obtain an absorbtion of the additive in porous prills, e.g. to achieve good distribution in case the acid has a high fuel value. Solid acids are generally preferred as they can be added in powder form, suitably with particle sizes clearly less than that of the salt in accordance with what has been said above for fine material. A pulverulent additive ends up at the surface of the salt particles for best interaction with the surroundings and where it also gives a certain improved consistency by acting drying on the mixture and counteracting caking. Pulverulent additives are also easily handled at preparation of the mixture.

The acid needs not be strong, as the stronger acids may cause corrosion of the skin and construction materials in the vicinity, but may have pKa-values within a broad interval, for example between 1 and 10, or preferably between 2 and 8, at room temperature. It is preferable that the acid has a certain buffering or durably neutralizing effect and di- or polyvalent acids are preferred. With consideration to the intended action it is further preferable for best effect that the acid used has a high water solubility, for example exceeding 25 g per liter water, more preferably exceeding 100 g per liter and most preferably exceeding 500 grams per liter water at room temperature. Hence among inorganic acids the slightly stronger are preferred and among organic the more low molecular or those having hydrophilic substituents, such as alcohol groups.

Inorganic acids can be used, which often have beneficial price and give easily handled mixtures, for example boric acid if a solid additive is desired or diluted nitric acid if a fluid additive is desired. Organic acids are generally preferred for abovesaid reasons, suitably with between 1 and 12 carbon atoms. These may be monocarboxylic acids with 1 to 10 carbon atoms, e.g. formic acid, acetic acid, propionic acid, benzoic acid, or hydroxyacids of these. More preferably polyvalent acids are used with 2 to 12 carbon atoms, and in particular 3 to 10 carbon atoms, for example oxalic acid, malonic acid, succinic acid, glutaric acid, maleic acid of fumaric acid and in particular the hydroxy substituted such as saccharic acid, glyceric acid, malic acid, tartaric acid or in particular citric acid.

The acid amount in the ready explosive composition depends partly on the pro weight neutralizing ability of the selected acid and partly on the content of basic material in the surroundings of intended use for the composition. As an indication can be said that the acid amount, calulated as pure product, should constitute between 0.5 and 30 percent by weight of the explosive composition, and in particular between 1 and 20 percent by weight.

The abovesaid acid additive, like a number of the above enumerated conventional additives, may have a fuel value to which consideration should be given in formulating the total mixture composition and in selecting the amount of the above-said separately added fuel, which amount often can be reduced with 1 or 2 percent units. A suitable oxygen balance for the overall composition can be between −20% and +10%, especially between −10% and 75% and if possible close to zero. The oxygen balance concept here has its conventional meaning of weight difference between chemically available oxygen and oxygen required for complete combustion of fuels present, expressed as percent of composition total weight.

Mixture manufacture can be done in different ways. The conventional way to prepare ANFO is to spread fuel oil over prills conveyed under agitation. In such a process a fluid acid additive can be added together with the fuel oil, mixed with this if soluble therein or otherwise emulsified therein, for most simple introduction and best homogenity. Alternatively the acid additive can be spread from a separate nozzle, which is preferred for additives not miscible with the fuel oil, e.g. aqueous solutions of the acid, but also for achieving flexibility in manufacture of product with and without additive respectively. Spreading from a separate nozzle may also be suitable for treating in other aspects already prepared product containing salt, fuel and possible other additives, e.g. at addition of the acid additive locally at the blasting site in dependence of the current need for treated product. Pulverulent acid additive can be added the particles of oxidizing salt before or parallel with addition of the fuel oil, for most homogeneous admixture and lowest segregation risk, or preferably after addition of the fuel oil for best distribution of oil in prills, best activity of acid additive and improved composition theology and flow properties in general. Mixing devices with little shear can be used such as screw or paddle mixers or alternatively the powder can be blown into the rest of the mixture.

The compositions of the present invention can be charged and used in the same way as conventional particulate explosives such as ANFO. They can be poured into boreholes but are sufficiently free-flowing or dry for blowing, which method is competitive in most applications. Conventional methods and devices can be used in this connection, such as blowing from pressurized vessels, blowing with direct injection of gas under pressure or with ejector action or a combination thereof. The compositions easily charge in this way without equipment deposits and sustain the forces involved without segregation.

According to the invention the compositions are preferably used in basic environments, especially in contact with basic materials, such as basic minerals or especially basic construction materials such as cement and concrete, e.g. floor or reinforcing constructions underground. As a general indication the basic material in contact with room temperature water can have a saturation-pH beween 7 and 14, preferably between 8 and 12. Contact between explosive composition and the basic material can occur in various ways, for example intentionally by charging the composition in holes provided in the basic material, such as basic minerals, or unintentionally in that spillage after charging but before blasting or residues from the composition after blasting comes into contact with the basic materials. The invention generally obviates the problems with ammonia release in these connections to avoid exposure of personnel in operations before and after blasting but is of particular value at work in the vicinity of populated areas or in closed spaces such as blasting operations in buildings and in underground operations in particular.

EXAMPLE 1

Ammonium nitrate in the form of porous prills with a particle size around 1 to 2 mm and a bulk density around 0.85 g/cc in an amount corresponding to 89.3 parts per weight per time unit was conveyed in a screw feeder. To the stream of prills were conveyed with another screw feeder 6.0 parts by weight per time unit of citric acid monohydrate in the form of a free-flowing crystalline powder. After a short mixing distance fuel oil was sprayed in the form of a fine spray in an amount of 4.7 parts by weight per time unit over the powder mixture. After another mixing distance the product was ejected and packed. The product was employed in an underground mine, with nearby concrete reinforcements, under conditions identical to earlier blasts with conventional ANFO, when ammonia release had been severe enough to make further use of ANFO explosives impossible. With the above described product blasting results equivalent to when using conventional ANFO were achieved but with small enough ammonia release to allow work at the blasting site.

EXAMPLE 2

A product was prepared according to Example 1 but with 84 parts by weight per time unit of prills, 12 parts by weight per time unit of the citric acid and 4.0 parts by weight per time unit of the fuel oil. When blasting in the same environment the ammonia release was insignificant and made possible work without discomfort in the space of the blast.

EXAMPLE 3

A conventional ANFO, consisting of 94.5 parts by weight prills according to Example 1 and 5.5 percent by weight fuel oil, is charged by pressurized air in a conventional manner in an environment according to Example 1. In connection with the charging a concentrated water solution of 1000 grams tartaric acid in 1000 grams of water is dosed by means of a gear pump via a spray nozzle directly into the charging hose in an amount per time unit corresponding to 8 parts by weight solution per 92 parts by weight of ANFO. The blasting result is the same as when using ANFO and ammonia release insignificant.

I claim:

1. In a porous pulverulent explosive composition comprising free-flowing solid particles of an oxidizing salt that include an ammonium ion, the improvement of providing within said explosive composition a solid water-soluble acid which is capable of neutralizing liberated ammonia from within said porous pulverulent explosive composition thereby rendering said composition particularly suited for usage in a basic environment while enhancing the quality of the nearby environment.

2. A porous pulverulent explosive composition according to claim 1 wherein said solid water-soluble acid is present in a concentration of 0.5 to 30 percent by weight of the total composition.

3. A porous pulverulent explosive composition according to claim 1 wherein said solid water-soluble acid is present in a concentration of 1 to 20 percent by weight of the total composition.

4. A porous pulverulent explosive composition according to claim 1 wherein said solid water-soluble acid has a pKa value at room temperature within the range of 1 to 10.

5. A porous pulverulent explosive composition according to claim 1 wherein said solid water-soluble acid has a pKa value at room temperature within the range of 2 to 8.

6. A porous pulverulent explosive composition according to claim 1 wherein the solubility at room temperature in water of said solid water-soluble acid exceeds 25 grams per liter.

7. A porous pulverulent explosive composition according to claim 1 wherein the solubility at room temperature in water of said solid water-soluble acid exceeds 100 grams per liter.

8. A porous pulverulent explosive composition according to claim 1 wherein the weight average particle size of said solid water-soluble acid is less than the weight average particle size of said oxidizing agent.

9. A porous pulverulent explosive composition according to claim 1 wherein the oxygen balance exhibited by said composition is between –20% and + 10%.

10. A porous pulverulent explosive composition according to claim 1 wherein the oxygen balance exhibited by said composition is between –10% and +5%.

11. A porous pulverulent explosive composition according to claim 1 wherein solid water-soluble acid is an organic acid.

12. A porous pulverulent explosive composition according to claim 1 wherein said solid water-soluble acid is a polyvalent organic acid having 2 to 12 carbon atoms.

13. A porous pulverulent explosive composition according to claim 1 wherein said solid water-soluble acid is a polyvalent organic acid having 3 to 10 carbon atoms.

14. A porous pulverulent explosive composition according to claim 1 wherein said solid water-soluble acid is an hydroxyacid and is selected from the group consisting of malonic acid, tartaric acid, and citric acid.

15. A porous pulverulent explosive composition according to claim 1 wherein said oxidizing salt is prilled ammonium nitrate.

16. In a porous pulverulent explosive composition comprising free-flowing solid particles of an oxidizing agent of prilled ammonium nitrate, the improvement of providing 0.5 to 30 percent by weight of the total composition of a water-soluble hydroxyacid selected from the group consisting of malonic acid, tartaric acid, and citric acid which is capable of neutralizing liberated ammonia from within said porous pulverulent explosive composition thereby rendering said composition particularly suited for usage in a basic environment while enhancing the quality of the nearby environment.

* * * * *